US006410856B1

(12) United States Patent
Kimble

(10) Patent No.: US 6,410,856 B1
(45) Date of Patent: Jun. 25, 2002

(54) KIT FOR ENABLING GUY-WIRE GUARDS TO SPIN

(76) Inventor: Stephen E. Kimble, 12840 E. Cabeza de Vaca, Tucson, AZ (US) 85749

( * ) Notice: Subject to any disclaimer, the term of this patent is extended or adjusted under 35 U.S.C. 154(b) by 0 days.

(21) Appl. No.: 09/397,476

(22) Filed: Sep. 16, 1999

(51) Int. Cl.[7] ..... H01B 7/24

(52) U.S. Cl. ..... 174/136; 174/5 R; 174/45 R; 174/135; 52/147

(58) Field of Search ..... 174/5 R, 45 R, 174/45 TD, 135, 136; 52/146, 147, 148

(56) References Cited

U.S. PATENT DOCUMENTS

| | | | | | |
|---|---|---|---|---|---|
| 1,902,945 | A | | 3/1933 | Blackburn | |
| 2,001,893 | A | | 5/1935 | Seelye | 189/31.5 |
| 3,173,519 | A | | 3/1965 | Sullivan | 189/31.5 |
| 3,428,742 | A | | 2/1969 | Smith | 174/136 |
| 3,897,664 | A | * | 8/1975 | Bogese | 52/147 |
| 3,926,141 | A | | 12/1975 | Taylor | 116/114 |
| 3,999,340 | A | * | 12/1976 | Bogese | 174/136 |
| 4,135,336 | A | * | 1/1979 | Bogese | 52/147 |
| 4,223,491 | A | * | 9/1980 | Vaughn | 52/147 |
| 4,407,600 | A | | 10/1983 | Thompson | 403/23 |
| 4,453,353 | A | | 6/1984 | Killop et al. | 52/147 |
| 4,638,611 | A | * | 1/1987 | Vaughn | 52/147 |
| 4,962,620 | A | | 10/1990 | Mastalski | 52/147 |
| 5,038,705 | A | | 8/1991 | Shapiro et al. | 116/209 |
| 5,119,607 | A | * | 6/1992 | Horning et al. | 52/147 |
| 5,517,792 | A | | 5/1996 | Champa et al. | 52/147 |

* cited by examiner

*Primary Examiner*—Dean A. Reichard
*Assistant Examiner*—Adolfo Nino
(74) *Attorney, Agent, or Firm*—Antonio R. Durando; Gavin J. Milczarek-Desai

(57) ABSTRACT

A guy-wire guard support apparatus prevents personal injury or damage resulting from climbing or playing on guy wires by causing the guard to spin freely upon contact. The apparatus consists of a collar-like component and a cup-like component both of which contain a free-wheeling element such as ball bearings. By mounting or seating a guard upon or within at least one of each component, the guard can easily spin about its axis, thereby hindering attempts to grasp or stand on it. Another embodiment consists of multiple collars attached to the wire and circular shoulders inside the guard resting on rollers in the top of each collars.

21 Claims, 5 Drawing Sheets

KIT FOR ENABLING GUY-WIRE GUARDS TO SPIN

BACKGROUND OF THE INVENTION

1. Field of Invention

This invention relates in general to the field of guy-wire safety devices and in particular to support structures that deter climbing by enabling guy-wire guards to spin when contacted.

2. Description of Related Art

Guy wires are a type of bracing cable used to stabilize structures such as utility poles, antennae, transmission towers, and the like. Unfortunately, the use of these wires presents a number of problems. One problem is that a typical guy wire has a relatively small diameter, and, thus, it is not readily visible. As a result, accidental collisions occur involving pedestrians or vehicles. To resolve this problem, engineers often partially encase guy wires in protective sheathes termed "guards" made from highly-visible plastic or similar material.

Accordingly, there exist many different guards designed to increase guy wire visibility. For example, U.S. Pat. No. 3,926,141 by Taylor describes a wire guard comprising a plurality of substantially identical, interlocking modular units. Each brightly-colored modular unit is formed of a pair of interlocking half-shell sections that are snapped together about a guy wire.

Similarly, U.S. Pat. No. 5,038,705 by Shapiro et al. describes a hollow tubular casing that is constructed to diffuse light and has a longitudinal slit through which it may be pressed upon a wire.

While these inventions have increased guy wire visibility, other problems relating to damage caused by the impact of objects such as tree branches or by intentional tampering have fueled the desire to make guards more durable. For example, U.S. Pat. No. 3,173,519 by Sullivan describes a guard mounted axially through a longitudinal slit upon a plurality of supporting structures attached to the guy wire. The presence of these supporting structures provides two advantages. First, they provide a means of attaching the guard to the wire at multiple points so as to frustrate guard removal. Second, they provide an internal support structure that aids in the deflection of blows to the guard.

Despite these improvements in guard visibility and durability, there is still a need for safety design improvements that specifically address the problem of guy wire climbing. This need is made urgent by the fact that the location and design of many existing guards inadvertently attract and assist climbers. For example, wire guards typically are placed close to the ground so as to be most visible to pedestrians or vehicles. Hence, guards made up of snugly-attached, modular subunits, as described in U.S. Pat. No. 2,001,893 by Seelye and U.S. Pat. No. 3,926,141 by Taylor, can be used by a child as handholds from which to hang or scale an attached wire. Another reason why safety design improvements are needed relates to the common use of tubular guards that are placed vertically on parallel guy wires attached to power poles, as illustrated in FIG. 1. For example, with guards, such as illustrated in U.S. Pat. Nos. 4,453,353 by Killop et al. and 5,517,792 by Champa et al., that have been affixed to guy wires in relatively closely-spaced, vertical pairs, the bottom guard serves as a foothold while the climber grips the upper guard to keep her balance and thereby "walk" up the guy wire.

Because their design and location make guards especially accessible to children, guy-wire play has become a serious liability and expense concern. For not only does scaling or otherwise playing on wires imperil the climber, it also necessitates the repair of power pole components and the replacement of guards due to damage incurred as a result of hanging from or standing atop them. Thus, a dangerous and expensive problem exists due to a propensity to use guards as aids in climbing on guy wires.

Some guy-wire guard improvements have been aimed at reducing damage caused by vandalism. However, a survey of such guard designs reveals that the problem of climbing has yet to be effectively addressed. For example, U.S. Pat. No. 4,962,620 by Mastalski discloses a protective sleeve specifically designed to resist damage caused by twisting. When a twisting force is applied, the guard responds by slipping along an axial groove present in a guard mounting collar and within which guard-integrated rivets are seated. However, the guard also includes a helical strap twisted around the wire to tightly grip it to prevent axial displacement. Thus, climbing or standing on the guard would not produce the free spinning motion needed to prevent or dislodge a handhold or foothold because the frictional resistance caused by the strap and the rivets engaging the groove would serve to inhibit rotation. Consequently, there continues to be a need for guy-wire guards that effectively frustrate attempts to play on and climb up them.

BRIEF SUMMARY OF THE INVENTION

It is an object of the invention to prevent injury by providing a means for guy-wire guards to safely inhibit climbing, hanging from, or standing upon them.

A further object of the invention is to provide a means of discouraging climbing-, hanging-, or standing-induced damage to guy-wire guards.

Another object of the invention is to provide a means of inexpensively improving guy wire safety and longevity.

Yet another object of the invention is to provide a means of retrofitting a conventional guy wire guard so that it prevents climbing or other deliberate interference with the wire.

In accordance with these objectives, the invention consists of collar- and cup-like components that contain free-wheeling elements, such as ball and similar bearings, so as to provide both structural support and a mechanism upon which a guard is free to spin about its longitudinal axis in response to contact such as grasping or standing.

In achieving these objectives, one or more collar-like components of the present invention are attached to a guy wire in a circumferential support position so as to provide an approximately cylindrical surface fixed to the guy wire upon which the inner portion of a guard may easily rotate. Additionally, a cup-like body is placed on the wire to support the bottom-end portion of the guard, thereby preventing downward translation of the guard along the wire and providing a surface upon which the end portion of the guard may spin.

In another embodiment of the invention, collar-like components attached to the guy wire are combined with a modified guard having inner grooves adapted to receive the bearing portion thereof, such as to eliminate the need for a supporting cup-like component.

The main advantage of the present invention is that it minimizes the chances of personal injury and damage to guards caused especially by deliberate contact, such as horseplay. Because many existing guy wires and guy-wire guards are designed and placed in such a way as to unintentionally provide both access to and a means by which one may climb pairs of guy wires, the ability to rapidly rotate in response to contact improves guard safety. A second major advantage of the invention is that the collar- and cup-like bodies can be inexpensively manufactured in a variety of standard sizes so as to fit new and existing guards alike.

DETAILED DESCRIPTION OF THE INVENTION

The invention is based on the idea of minimizing the potential for personal injury or property damage resulting from climbing or playing on guy wires by providing a support assembly that enables a guard to freely spin about its axis, thereby hindering attempts to grasp or stand on it.

One preferred embodiment of the invention, designed for the purpose of retrofitting existing guy-wire guards, consists of a kit containing two types of members, a cup-like component and a collar-like component. Both of these components generally consist of a support body, a means of attachment, and a free-wheeling element. The support body may be made of any durable material, such as hard plastic or aluminum. Integrated into this support body is a means of clamping or otherwise attaching the body to the guy wire, such as a screw or collar clamp, and a free-wheeling element such as a race or journalled ball bearings.

Figure 1:
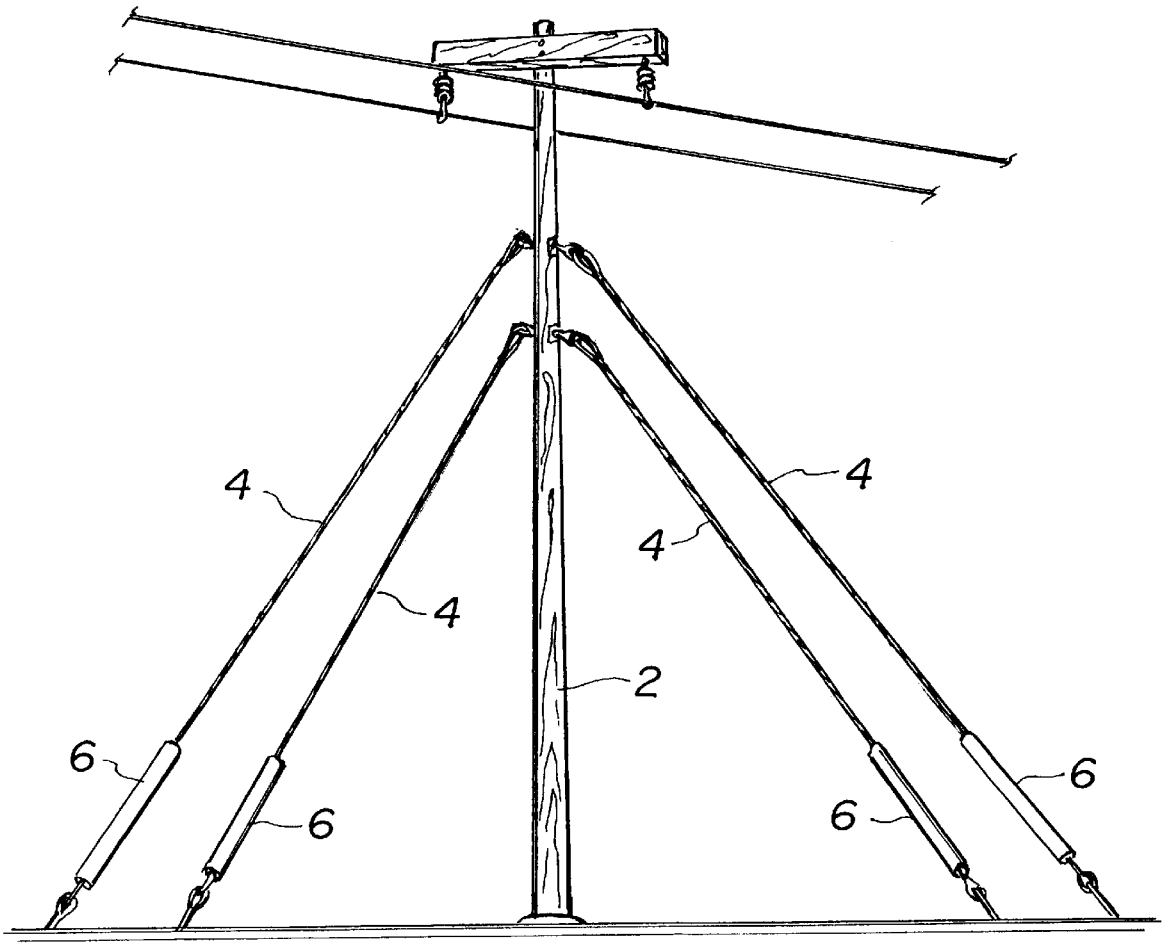
FIG. 1 (PRIOR ART)
FIG. 1 depicts schematically the general appearance and location of guy-wire guards as found on a typical utility pole.

Referring to FIG. 1, a typical utility pole 2 to which guy wires 4 and plastic guards 6 are attached is shown. Because the plastic guards 6 are firmly installed close to the ground, climbers can easily reach and use them to play or hang upon guy wires. Moreover, the common placement of guy wires and their guards in vertical pairs inadvertently provides a handhold and foothold for climbers. The kit of the present invention is designed to stop horseplay such as hanging and climbing by causing the guard 6 to rapidly spin around the guy wire 4 in a manner that would prevent one from establishing his or her grip or footing upon the guard.

Figure 2:
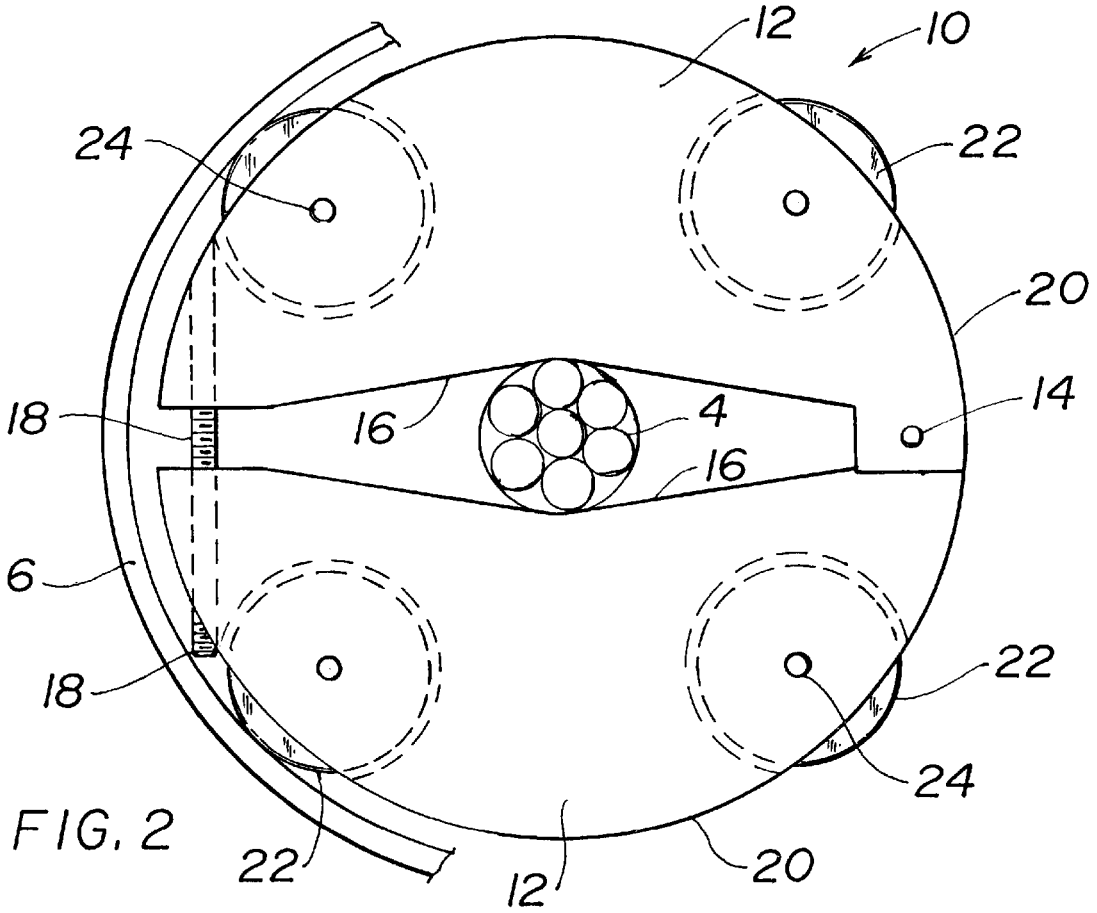
FIG. 2 is a schematic top view of a collar-like component of the invention and of a partially cut-out guard as they would appear after installation on a guy wire.

As shown in FIG. 2, the collar-like component 10 of the preferred embodiment of the invention consists of two substantially semi-cylindrical members 12 connected at one end by a hinge 14 to form a collar structure. The inner surface 16 of each member 12 is shaped to provide an axial cavity or groove adapted to receive and hold in place a guy wire 4 compressed between them. As also shown in the elevational view of FIG. 3, a lock screw 18 is used to connect the members 12 on the side opposite the hinge 14 and securely clamp the collar structure to the guy wire 4.

The outer, substantially semi-cylindrical surface 20 of each member 12 incorporates a free-wheeling bearing structure designed to prevent its frictional engagement of the inner tubular surface of the guard 6. Preferably, such bearing structure consists of equally-spaced cylindrical or spherical bearings 22 rotatably mounted in an appropriate housing in each member 12 by means of longitudinal support axles 24 (also shown in phantom line in FIG. 3). Thus, any surface pressing against a bearing 22 will cause the bearing to freely rotate, so that the surface will be prevented from being engaged thereby.

After the collar-like component 10 is installed on the guy wire, the guard 6 is slided over the component. The guard 6 is mounted, for example, by pulling along the longitudinal slit (not pictured) normally found in prior-art guards for installation over wires already in place. Thus, the resilient guard can be opened wide enough to slip it over the collar-like component 10 with the guard's interior surface engaged by the bearings 20. Other guards may. be designed for assembly through modular "snap together" type of components in which two interlocking halves can be fastened over a wire. These types of guards can obviously be also so assembled over the collar-like components of the invention.

In any case, the guard should be sized so as to circumferentially contact the bearings 22. Of course, each component 10 can be manufactured and adjustably tightened to fit various standard size wires, which typically range from 3/16" to ½" in diameter (but can be larger). Moreover, depending on the amount of guard support and deflection strength desired, more than one collar-like component can be attached to the wire, preferably spaced no more than 24 inches apart. It is also recognized that a single piece collar-like component 10, including both cylindrical members 12, may be manufactured of strong and resilient material without the hinge 14.

An adjustable lock screw 18 is used to tightly fasten the collar-like component 10 to the wire 4. As better seen in the elevational view of FIG. 3, the head region of the adjustable lock screw 18 may contain a single or crossed slot by which the screw can be turned, thereby opening or closing component 10, with an ordinary standard or Phillips-type screwdriver. Thus, the collar-like component 10 can be easily installed using common hand tools. While the preferred embodiment contains a lock screw 18 seated in one circular member 12 and threaded into a hole in the other, as shown in the figures, various other means of fastening the component 10 to the wire may be utilized.

Figure 4A:
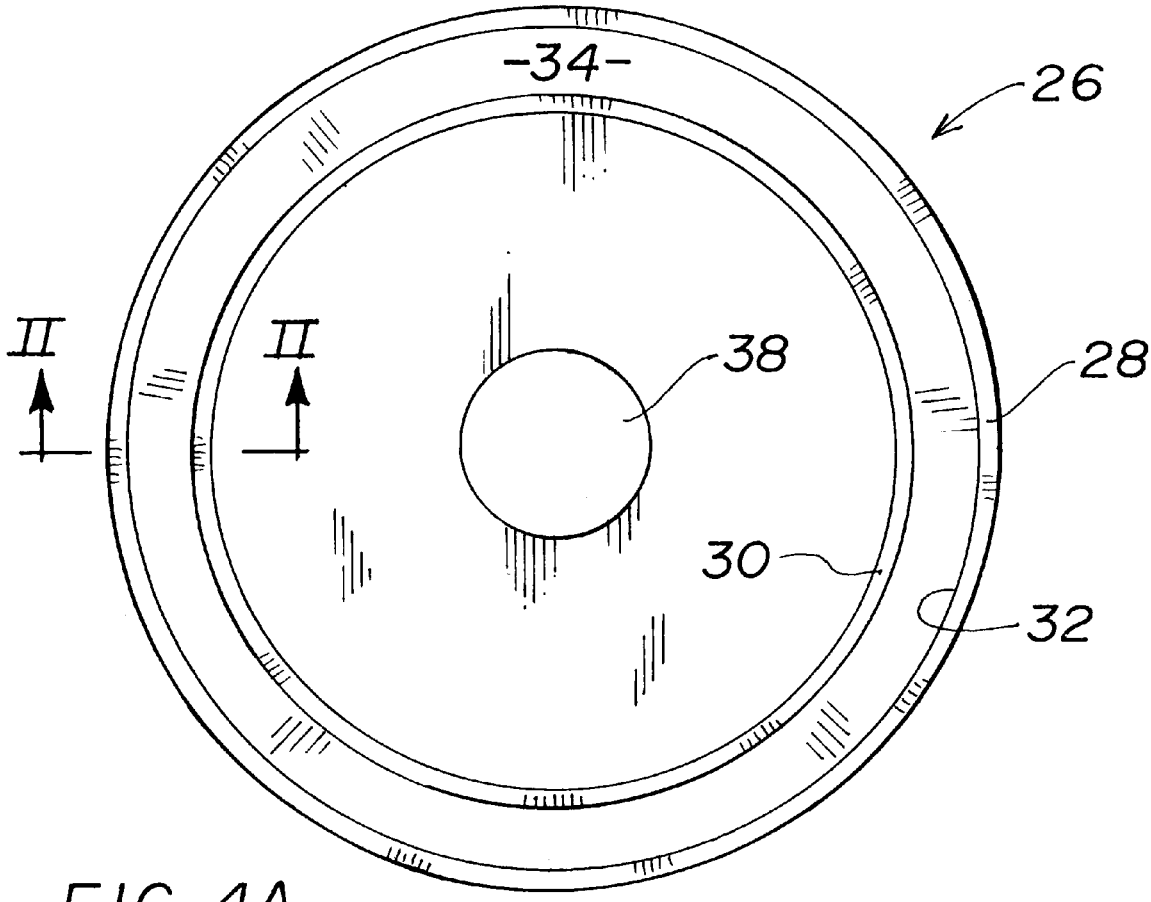
FIG. 4A is a schematic top view of a cup-like component of the invention used to provide axial support to the guard mounted on a guy wire.
Figure 4C:
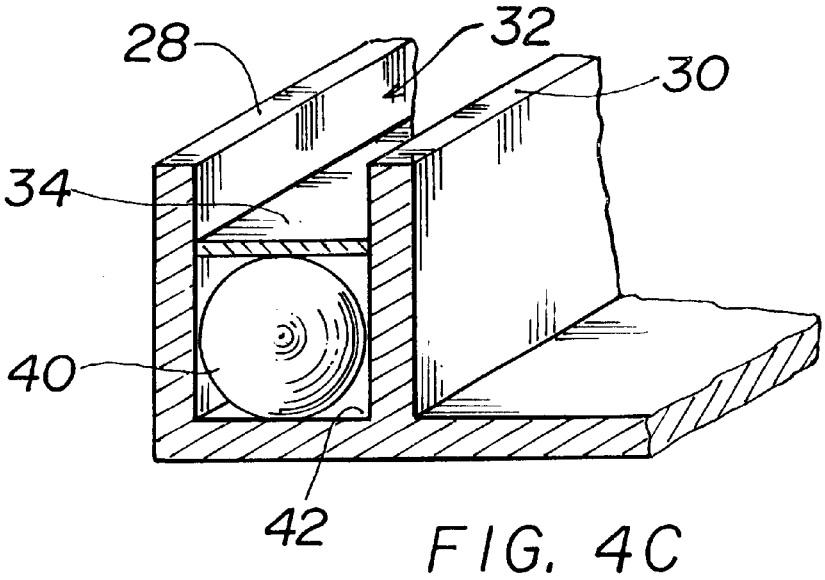
FIG. 4C is an enlarged partial cross-sectional view of FIG. 4A taken along line II—II in that figure.
Figure 4B:
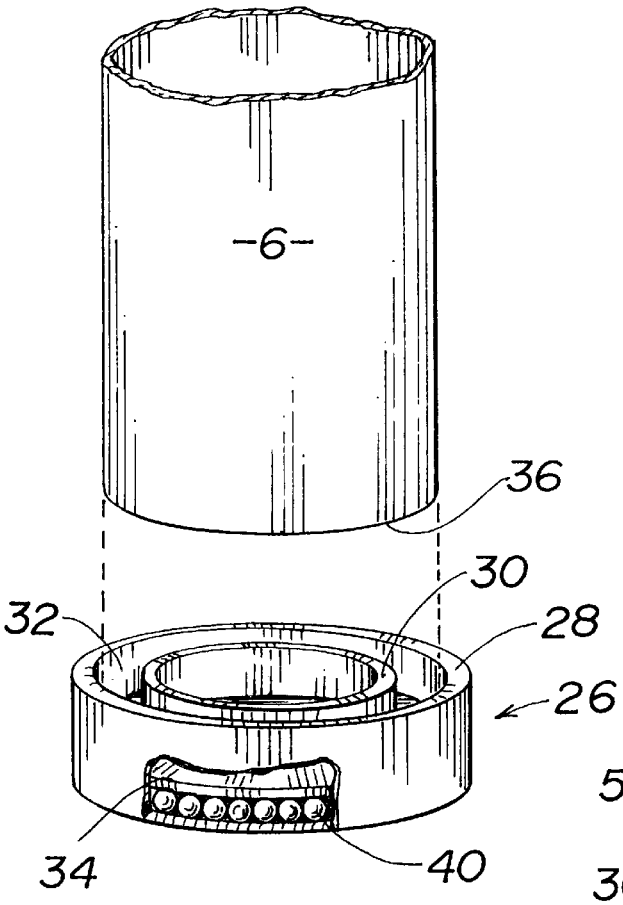
FIG. 4B is a side view of the component of FIG. 4A, wherein a cut-away portion shows the interior race upon which the bottom end of a guard would rest.

In addition to a collar-like component 10, this embodiment of the invention also includes a cup-like component as seen in three different views in FIGS. 4A–4C. As viewed from the top in FIG. 4A, the cup-like component 26 is a structure that contains an outer raised shoulder 28 and an inner raised shoulder 30 between which a race 32 is formed. In essence, the raised shoulders 28 and 30 form a groove in which the bottom end of a guard 6 is placed so as to contact a free-wheeling annular support surface 34 (see also FIGS. 4B and 4C). Thus, this appropriately-sized cup-like component is mounted on a guy wire such that the guard bottom end (FIG. 4B) is contained within the cup section with the bottom edge 36 of the guard resting on the annular support structure 34.

Thus, the cup-like component 26 provides a support structure that keeps the guard 6 from sliding down the guy wire 4 while preserving its rotatability. In the embodiment illustrated in the figures, the cup-like component 26 consists of a single-piece component with a hole 38 sized to allow its installation on the guy wire 4 by inserting the wire's end therethrough before anchoring the wire to the ground. The component 26 is then allowed to slide to the bottom of the wire and rest there during use. In another embodiment (not shown) the cup-like component may consist of two interlocking halves that can be snapped into place just above the large loop by which a guy wire typically is attached to an anchoring structure in the ground. The support structure 34 would then consist of a resilient slitted annular member capable of being expanded radially and passed around the guy wire before being seated in the race 32.

FIG. 4B depicts a side view of the cup-like component 26 in which the three dimensional character of the raised annular shoulders 28 and 30 defining the race 32 is readily apparent. By seating the end of a guard 6 upon the support structure 34 which freely spins over the ball bearings 40 (or equivalent bearing means), the guard 6 is supported and prevented from sliding downward while retaining the guard's free-wheeling capability provided by the collar-like components 10 installed along the length of the guard. This is an improvement over other arguably rotatable guards that either have no end support or that contain elements which inhibit spinning by producing significant drag when the guard is rotated.

FIG. 4C shows an enlarged cross-sectional view taken from line A—A in FIG. 4A. As seen in detail in this view, the race 32 is defined by the annular groove contained within the shoulders 28 and 30 and the bottom surface 42. This groove is sized so as to allow seating of a guard 6 and to provide a track within which ball bearings 40 or other suitable free-wheeling means may run. In the preferred embodiment, the top of the support structure 34 is covered with a rubbery material capable of providing a stable surface upon which the guard 6 will stay firmly seated while it spins smoothly within the race 32.

Figure 5:
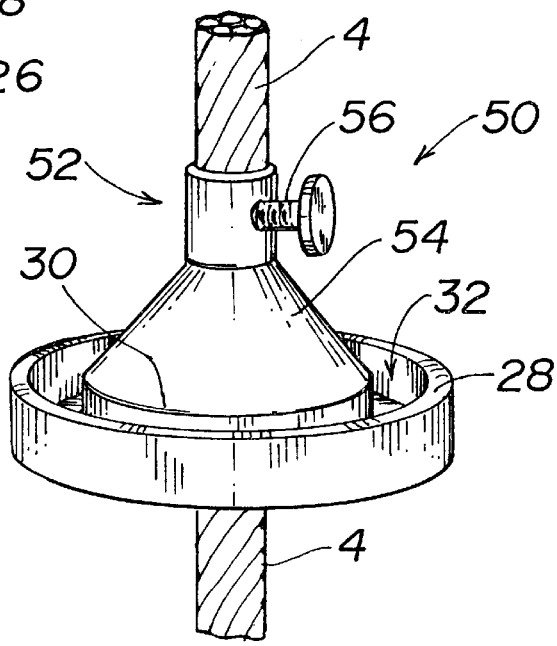
FIG. 5 is a perspective view of another embodiment of the cup-like component used to support the guy-wire guard.

As shown in FIG. 5, another embodiment 50 of the cup-like component of the invention may include a mechanism 52 for fastening it to a guy wire at any desired elevation (that is, without having to rely on an extraneous supporting element, such as the wire's anchor to the ground. As illustrated, a frustaconical or similar structure 54 is used in the region defined by the inner shoulder 30 to anchor the cup-like component 50 to the guy wire 4. One or more locking screws 56 are provided to clamp the component 50 to the wire 4. As would be clear to one skilled in the art, the component 50 is mounted by first threading the guy wire 4 therethrough at a free end and then tightening the locking screw 56 to secure the cup-like component 50 in place. Again, this component could alternatively be manufactured in two interlocking pieces (not shown) that could be installed by clamping them around the wire and then inserting a slitted annular support structure in the race by passing it around the wire, as explained above. The locking screw 56 would then be employed to tightly attach the component to the wire 4.

Having the frustaconical region 54 directed upwards is advantageous because it hides the locking screw 56, and, thus, it discourages removal of the component by youths or vandals. Other embodiments limiting exterior access to the clamping means may also be desirable. For example, a second cup-like component could be installed up-side-down at the top of the guard 6. This would be advantageous in terms of excluding foreign matter from the collar-like components 10 and the bottom cup-like components 26 or 50, thereby keeping the bearings cleaner and free of corrosion. Furthermore, placing a cup-like component at the top of a guard would prevent would-be tamperers from pushing the guard 6 up the wire 4 to expose the bottom component or the wire itself.

Figure 3:
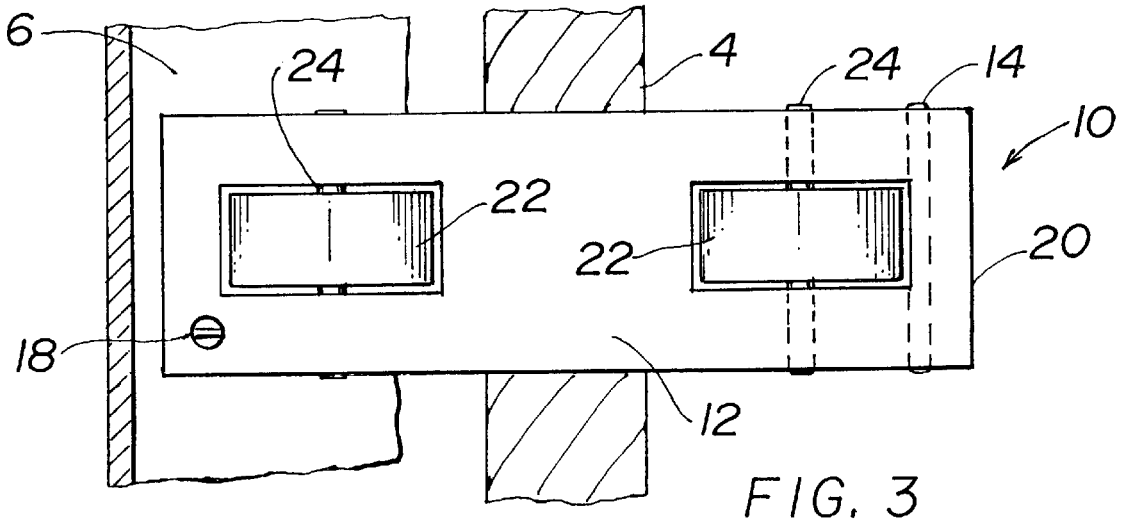
FIG. 3 is an elevational side view of the component of FIG. 2 showing the fastening screw by which it is attached to a guy wire.
Figure 6:
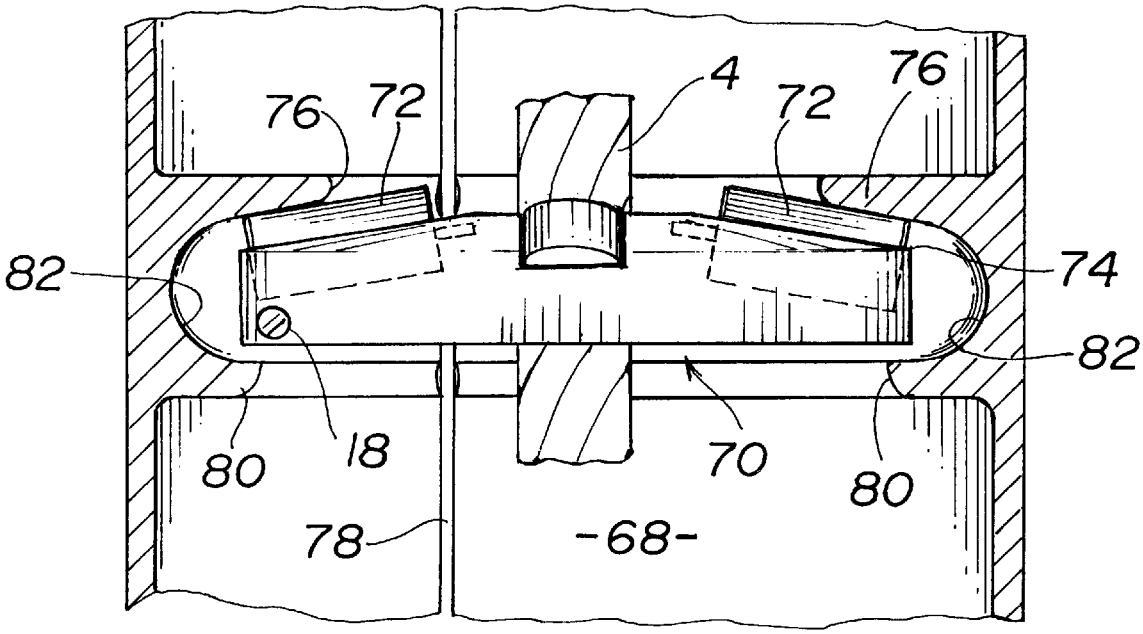
FIG. 6 is an elevational side view of another embodiment of the invention showing multiple rollers in the top of a collar to provide vertical as well as circumferential support to a shoulder structure attached to the interior wall of a guard.
Figure 7:
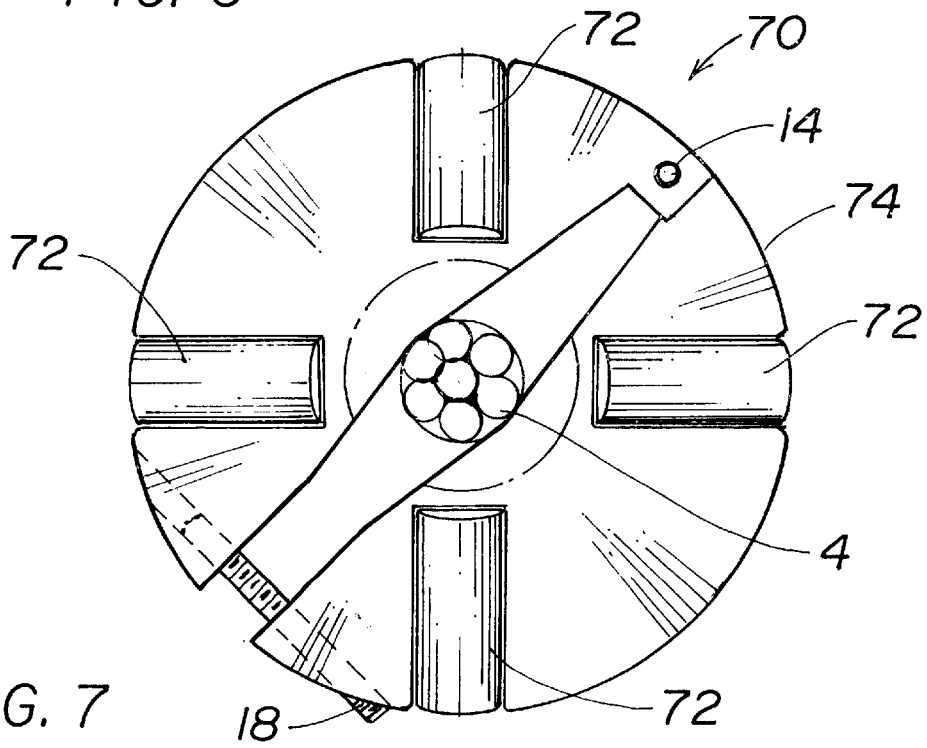
FIG. 7 is a schematic top view of the collar of FIG. 6 installed on a guy wire.

In another embodiment of the invention, a guy-wire guard 68 may have one or more bearings or other free wheeling means incorporated directly into the guard structure. As illustrated in the sectioned elevational and the top views of FIGS. 6 and 7, an inner collar 70 is mounted on the guy wire 4 by clamping it with a lock screw 18 in the same way the embodiment of FIGS. 2 and 3 is installed. The difference is in the placement of the bearings, which in this case are preferably cylindrical rollers 72 disposed at an angle with respect to the outer perimeter 74 of the collar 70. The idea is for the rollers 72 to provide rotational support both circumferentially (like the bearings 22 of the collar-like component 10) and vertically in order to fully support a circular channeled structure mounted around them. Accordingly, the interior of the guard 68 (shown only in FIG. 6) is provided with an inward-facing channel having an annular top shoulder 76 conforming to the size of the collar 70 such that it rests on the rollers 72 when wrapped around the collar. Note that the same result could be achieved with an equivalent structure including two sets of bearings, one on top of the collar 70 and one around its side (as in the case of the component 10).

Obviously, several such structures are needed along the length of the guard 68 to fully support it and allow it to spin freely under pressure. Using the prior-art plastic material typically utilized for conventional guards, it is recommended that a collar 70 and a corresponding support shoulder 76 be placed at least every two feet; that is, at least 4 to 5 should be used for a typical 9-foot long guard. Guy-wire guards need to be long in order to make it difficult for people to bypass them as they begin climbing the lower part of the wires.

In order to allow the installation of the guard 68 on an existing guy wire, the guard is provided with a longitudinal slit 78 that makes it possible to resiliently open the guard and place the annular shoulders 76 over the rollers 72 after installation of the collars 70 on the wire. A lower shoulder 80 may also be provided for each upper shoulder 76 to fully define a channel 82 for preventing the guard's vertical displacement. The polyvinyl chloride and polyethylene materials used for guy-wire guards are sufficiently resilient and yet rigid to allow the opening of the slit 78 to snap the channel 82 in place around the collars 70.

It is noted that since the weight of the guard and any pressure exerted by a climber always cause the shoulder 76 to rest on the rollers 72, the lower shoulder 80 is not necessary to practice the invention. Similarly, since guy wires are always placed at an angle (normally ranging from 35 to 60 degrees), the rollers 22 (or 72) below the wire are not likely to bear any weight when pressure is exerted by a climber or otherwise on the rollers above the wire. Therefore, the embodiments of the invention disclosed herein could be yet simplified by providing rollers only on the portion of the collar 10 (or 70) clamped facing up.

Thus, the invention teaches methods and apparatus for making guy-wire guards resistant to climbing either through the installation of kit components on new or existing guards or through the use of a new type of guard. The kit involves the use of at least one collar-like component and one cup-like component; the new guard involves the use of multiple collars with a guard fitted with conforming support channels. In all cases, the invention provides support means for a guard to freely spin around its guy wire.

Hence, it can be seen that the present invention prevents dangerous and destructive contact, such as produced by climbing, standing, and hanging. Moreover, the components of the invention are relatively simple and inexpensive to install on new or existing guards. Any durable and resiliently deflective material is suitable for constructing the various components. The various parts constituting a unit, such as the channel shoulders protruding inward from the interior wall of the guard 68, may obviously be built as integral components or attached after manufacture.

As would be understood by those skilled in the art, any number of functional equivalents may exist in lieu of the preferred embodiments described above. Thus, changes in the details, steps, and materials that have been described may be within the principles and scope of the invention illustrated herein and defined in the appended claims. Therefore, while the present invention has been shown and described in what is believed to be the most practical and preferred embodiments, it is recognized that departures can be made therefrom within the scope of the invention, which is not to be limited to the details disclosed herein but is to be accorded the full scope of the claims to embrace any and all equivalent products and methods.

I claim:

1. A support apparatus for a guard mounted on a guy wire, comprising:

means for journaling the guard in free rotational connection around the guy wire; and means for preventing an axial displacement of the guard.

2. The apparatus of claim 1, wherein said means for journaling the guard in free rotational connection includes a collar having a collar attachment means for clamping the collar to the guy wire, and having a collar bearing means for providing circumferential support to an interior surface of the guard.

3. The apparatus of claim 2, wherein said means for preventing an axial displacement of the guard includes a cup having a cup bearing means for providing axial support to the guard.

4. The apparatus of claim, 3, wherein said cup also has a cup attachment means for clamping the cup to the guy wire.

5. The apparatus of claim 4, wherein said collar attachment means comprises a collar locking screw, said collar bearing means comprises collar ball bearings, said cup attachment means comprises a cup locking screw, and said cup bearing means comprises cup ball bearings.

6. The apparatus of claim 2, wherein said collar attachment means comprises a locking screw.

7. The apparatus of claim 2, wherein said collar bearing means comprises ball bearings.

8. The apparatus of claim 1, wherein said means for preventing an axial displacement of the guard includes a cup having a cup bearing means for providing axial support to the guard.

9. The apparatus of claim 8, wherein said cup also has a cup attachment means for clamping the cup to the guy wire.

10. The apparatus of claim 9, wherein said cup attachment means comprises a locking screw.

11. The apparatus of claim 8, wherein said cup bearing means comprises ball bearings.

12. A spinning guard for a guy wire, comprising:

a plurality of collars, each collar having attachment means for clamping the collar to the guy wire, and having bearing means for providing vertical and circumferential support to a surface pressing upon the collar; and a guard having means for coupling the guard to the bearing means of said collars.

13. The guard of claim 12, wherein said attachment means comprises a locking screw.

14. The guard of claim 12, wherein said bearing means comprises roller bearings.

15. The guard of claim 12, wherein said attachment means comprises a locking screw; said bearing means comprises roller bearings; said means for coupling the guard to the bearing means of the collars includes a plurality of top annular shoulders attached to an interior wall of the guard, each of said shoulders being positioned over said bearing means of a collar; and the guard is made of rigid resilient material and includes a longitudinal slit for radially opening the guard and placing said plurality of top annular shoulders over the collars after installation thereof on the guy wire.

16. The guard of claim 12, wherein said means for coupling the guard to the bearing means of the collars includes a plurality of top annular shoulders attached to an interior wall of the guard, each of said shoulders being positioned over said bearing means of a collar.

17. The guard of claim 16, further including a bottom annular shoulder combined with each of said plurality of top annular shoulders to define a circular channel around each collar.

18. The guard of claim 16, wherein the guard is made of rigid resilient material and includes a longitudinal slit for radially opening the guard and placing said plurality of top annular shoulders over the collars after installation thereof on the guy wire.

19. A method of preventing climbing on a guy wire protected by a guard comprising the steps of:

(a) providing means for journaling the guard in free rotational connection around the guy wire; and (b) providing means for preventing an axial displacement of the guard.

20. The method of claim 19, wherein said step (a) is carried out by attaching a collar to the guy wire, said collar having a collar bearing means for providing circumferential support to an interior surface of the guard; and said step (b) is carried out by resting the guard in a cup having a cup bearing means for providing axial support to the guard.

21. The method of claim 19, wherein said steps (a) and (b) are carried out by attaching a plurality of collars to the guy wire, each collar having bearing means for providing vertical and circumferential support to a surface pressing upon the collar; and by providing a plurality of annular shoulders attached to an interior wall of the guard, each of said shoulders being positioned over said bearing means of collar.

* * * * *